US005865661A

United States Patent [19]

Cyrus et al.

[11] Patent Number: 5,865,661

[45] Date of Patent: Feb. 2, 1999

[54] TOY VEHICULAR DRIVE APPARATUS

[75] Inventors: Peter Cyrus; Steve Proctor; Sean Cryan; Rich Franko, all of Seattle; Matt Gibson, Spokane, all of Wash.; Peter M. Maksymuk IV; Leo M. Fernekes, both of New York, N.Y.; Stefan Rublowsky, Brooklyn, N.Y.; Eduard Kogan, Howard Beach, N.Y.; Scott J. Kolb; Eric S. Moore, both of New York, N.Y.; Dmitriy Yavid, Brooklyn, N.Y.; Christopher S. Cosentino, Staten Island, N.Y.

[73] Assignee: Parvia Corporation, Seattle, Wash.

[21] Appl. No.: 943,542

[22] Filed: Oct. 3, 1997

[51] Int. Cl.[6] ..... A63H 33/00; A63H 18/00

[52] U.S. Cl. ..... 446/136; 446/444; 446/446; 463/63

[58] Field of Search ..... 446/136, 135, 446/134, 133, 444, 445, 446, 455; 273/81 B; 463/58, 61, 63

[56] References Cited

U.S. PATENT DOCUMENTS

| | | | |
|---|---|---|---|
| D. 304,484 | 11/1989 | Knudsen . | |
| D. 306,188 | 2/1990 | Tapdrup et al. . | |
| D. 306,190 | 2/1990 | Poulsen . | |
| D. 307,775 | 5/1990 | Pedersen . | |
| D. 366,914 | 2/1996 | Frederiksen . | |
| D. 367,896 | 3/1996 | Knudsen . | |
| D. 367,897 | 3/1996 | Schmidt et al. . | |
| 1,393,163 | 10/1921 | Rasely . | |
| 2,639,545 | 5/1953 | Pastorius | 446/136 |
| 2,674,813 | 4/1954 | Hutchinson . | |
| 2,871,619 | 2/1959 | Walters . | |
| 2,942,354 | 6/1960 | Grain . | |
| 3,005,282 | 10/1961 | Christiansen . | |
| 3,025,626 | 3/1962 | Schumacher . | |
| 3,034,254 | 5/1962 | Christiansen . | |
| 3,162,973 | 12/1964 | Christiansen . | |
| 3,234,683 | 2/1966 | Christiansen . | |
| 3,236,004 | 2/1966 | Christiansen . | |
| 3,242,610 | 3/1966 | Christiansen . | |
| 3,284,946 | 11/1966 | Christiansen . | |
| 3,352,054 | 11/1967 | Glass et al. . | |
| 3,461,601 | 8/1969 | Kristiansen . | |
| 3,475,851 | 11/1969 | Christiansen . | |
| 3,597,858 | 8/1971 | Ogsbury . | |

(List continued on next page.)

FOREIGN PATENT DOCUMENTS

| | | | |
|---|---|---|---|
| 934484 | 5/1948 | France | 446/446 |
| 808441 | 7/1951 | Germany | 446/444 |
| 878912 | 6/1953 | Germany | 446/444 |
| 1 201 224 | 4/1966 | Germany . | |
| 1 252 106 | 4/1968 | Germany . | |
| 3147-315 | 7/1982 | Germany | 446/135 |
| 3529-097 | 2/1987 | Germany | 446/444 |
| 35 25 350 | 4/1987 | Germany . | |
| 36 04 271 | 1/1988 | Germany . | |
| 35 29 097 | 11/1989 | Germany . | |

*Primary Examiner*—Robert A. Hafer
*Assistant Examiner*—D. Neal Muir
*Attorney, Agent, or Firm*—Christensen O'Connor Johnson & Kindness PLLC

[57] ABSTRACT

A toy vehicular drive apparatus includes a first roadway having an electrically conductive underside and a second roadway having an electrically conductive top and being under the first roadway. A subsurface powered vehicle is movable on the second roadway and has electrically conductive elements in contact with the electrically conductive underside of the first roadway and in contact with the electrically conductive top of the second roadway. A power source connected to the first roadway and the second roadway electrically energizes the first roadway and the second roadway to provide power to the powered subsurface vehicle. The toy vehicular drive apparatus also includes a surface vehicle movable on the top of the first roadway. A magnet on the surface vehicle and a magnet on the powered subsurface vehicle provide interconnection of the surface vehicle and the powered subsurface vehicle to cause movement of the surface vehicle in response to movement of the powered subsurface vehicle.

23 Claims, 7 Drawing Sheets

U.S. PATENT DOCUMENTS 3,597,875 8/1971 Christiansen .
3,667,153 6/1972 Christiansen .
3,742,620 7/1973 Knoll .
3,981,506 9/1976 Daniel et al. .
4,028,844 6/1977 Dideriksen et al. .
4,176,493 12/1979 Dideriksen .
4,185,410 1/1980 Kristiansen .
4,203,248 5/1980 Tapdrup .
4,205,482 6/1980 Christiansen et al. .
4,214,403 7/1980 Knudsen .
4,245,400 1/1981 Johnson .
4,403,733 9/1983 Bach et al. .
4,430,063 2/1984 Bach et al. .
4,430,826 2/1984 Ryaa .
4,461,116 7/1984 Bach .
4,556,393 12/1985 Bolli .
4,579,041 4/1986 Organ et al. .
4,589,702 5/1986 Bach et al. .
4,685,884 8/1987 Rohan .
4,715,832 12/1987 Bach .
4,726,515 2/1988 Bolli et al. .
4,743,202 5/1988 Bach .
4,846,750 7/1989 Tapdrup .
4,854,742 8/1989 Bach .
4,861,306 8/1989 Bolli et al. .
4,874,176 10/1989 Auerbach .
4,883,440 11/1989 Bolli .
4,894,040 1/1990 Bach et al. .
4,897,066 1/1990 Tapdrup et al. .
4,937,181 6/1990 Rogers .
4,978,301 12/1990 Dodge .
4,988,322 1/1991 Knudsen .
4,988,324 1/1991 Ryaa et al. .
4,992,069 2/1991 Bolli et al. .
4,998,903 3/1991 Bolli et al. .
5,011,411 4/1991 Loewy .
5,015,210 5/1991 Dideriksen .
5,042,972 8/1991 Bach et al. .
5,049,078 9/1991 Thomsen .
5,049,104 9/1991 Olsen .
5,071,384 12/1991 Poulsen .
5,087,001 2/1992 Bolli et al. .
5,094,643 3/1992 Bolli et al. .
5,112,263 5/1992 Penillard et al. .
5,251,900 10/1993 Gallant .
5,304,086 4/1994 Bolli et al. .
5,322,466 6/1994 Bolli et al. .
5,326,267 7/1994 Brokaw .
5,348,478 9/1994 Bradshaw .
5,349,734 9/1994 Poulsen et al. .
5,360,364 11/1994 Poulsen et al. .
5,373,791 12/1994 Bach et al. .
5,378,191 1/1995 Ryaa .
5,380,232 1/1995 Berggreen et al. .
5,387,148 2/1995 Dideriksen et al. .
5,417,603 5/1995 De Chazal .
5,427,530 6/1995 Taggart .
5,427,558 6/1995 Knudsen et al. .
5,494,471 2/1996 Ryaa et al. .
5,580,295 12/1996 Ruzskai et al. .
5,596,181 1/1997 Bach et al. .
5,601,490 2/1997 Nakagawa et al. ..... 446/446 X
5,643,038 7/1997 Olsen et al. .
5,645,463 7/1997 Olsen .

TOY VEHICULAR DRIVE APPARATUS

FIELD OF THE INVENTION

The subject invention pertains to toy vehicular drive apparatuses and, more specifically, to toy vehicular apparatuses that accommodate realistic movement of toy vehicles on a toy building set by locating the bulky powered apparatus under the toy building set and magnetically interconnecting the powered apparatus to a surface vehicle viewed by the user.

BACKGROUND OF THE INVENTION

U.S. Pat. No. 1,084,370 discloses an educational apparatus having a transparent sheet of glass laid over a map or other illustration sheet that is employed as a surface on which small moveable figures are guided by the movement of a magnet situated below the illustration sheet. Each figure, with its appropriate index word, figure or image is intended to arrive at an appropriate destination on the top of the sheet and to be left there temporarily.

U.S. Pat. No. 2,036,076 discloses a toy or game in which a miniature setting includes inanimate objects placeable in a multitude of orientations on a game board and also includes animate objects having magnets on their bottom portions. A magnet under the game board is employed to invisibly cause the movement of any of the selected animate objects relative to the inanimate objects.

U.S. Pat. No. 2,637,140 teaches a toy vehicular system in which magnetic vehicles travel over a toy landscape as they follow the movement of ferromagnetic pellets through an endless nonmagnetic tube containing a viscous liquid such as carbon tetrachloride. The magnetic attraction between the vehicles and ferromagnetic pellets carried by the circulating liquid is sufficient to pull the vehicles along the path defined by the tube or channel beneath the playing surface.

U.S. Pat. No. 3,045,393 teaches a device with magnetically moved pieces. Game pieces are magnetically moved on a board by reciprocation under the board of a control slide carrying magnetic areas or elements longitudinally spaced apart in the general direction of the motion path. The surface pieces advance step-by-step in one direction as a result of the back and forth reciprocation of the underlying control slide.

U.S. Pat. No. 4,990,117 discloses a magnetic force-guided traveling toy wherein a toy vehicle travels on the surface of a board, following a path of magnetically attracted material. The toy vehicle has a single drive wheel located centrally on the bottom of the vehicle's body. The center of the gravity of the vehicle resides substantially over the single drive wheel so that the vehicle is balanced. A magnet located on the front of the vehicle is attracted to the magnetic path on the travel board. The magnetic attraction directly steers the vehicle around the central drive wheel along the path.

SUMMARY OF THE INVENTION

A toy vehicular drive apparatus includes a first roadway having an electrically conductive underside and a second roadway having an electrically conductive top and being under the first roadway. A subsurface powered vehicle is movable on the second roadway and has electrically conductive elements in contact with the electrically conductive underside of the first roadway and in contact with the electrically conductive top of the second roadway. A power source connected to the first roadway and the second roadway electrically energizes the first roadway and the second roadway to provide power to the powered subsurface vehicle. The toy vehicular drive apparatus also includes a surface vehicle movable on the top of the first roadway. A magnet on the surface vehicle and a magnet on the powered subsurface vehicle provide interconnection of the surface vehicle and the powered subsurface vehicle to cause movement of the surface vehicle in response to movement of the powered subsurface vehicle.

Preferably, the first roadway and the second roadway have electrically conductive material located on most of the underside of the first roadway and the top of the second roadway. The conductive elements of the powered subsurface vehicle are low friction to allow lateral movement of the powered subsurface vehicle with respect to the first roadway and the second roadway while maintaining electrical interconnection of the powered subsurface vehicle with the first roadway and the second roadway. The electrically conductive elements are preferably located on the top and on the bottom of the powered subsurface vehicle and are variable in height to maintain electrical interconnection of the powered subsurface vehicle with the first roadway and the second roadway as the distance between the first roadway and the second roadway changes. The height variation of the electrically conductive elements can be due to the flexibility of the electrically conductive elements or their springloaded attachment to the powered subsurface vehicle.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
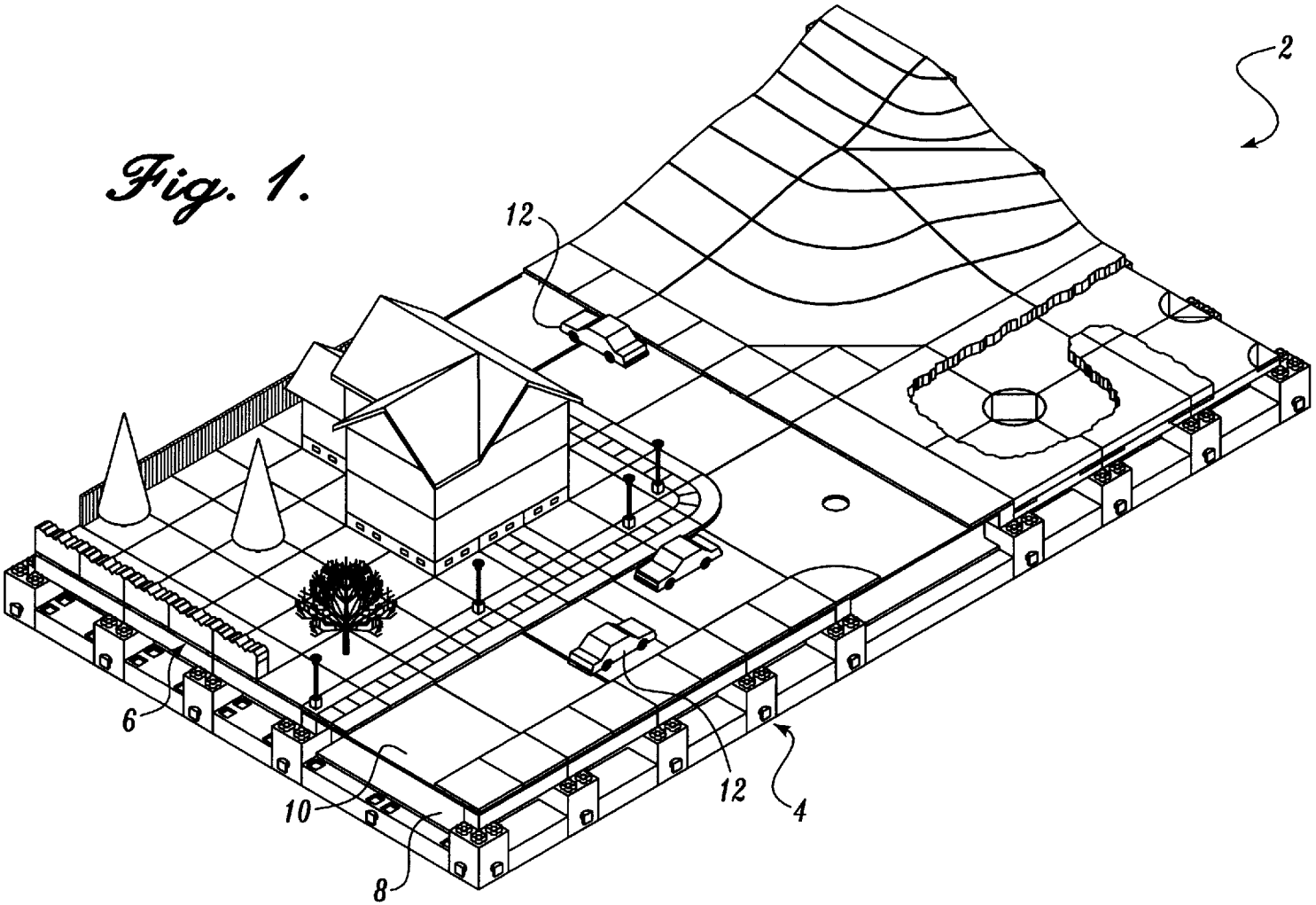
FIG. 1 is an isometric view of a toy building set including the upper roadway and lower roadway of the toy vehicular drive apparatus of the present invention.
Figure 2:
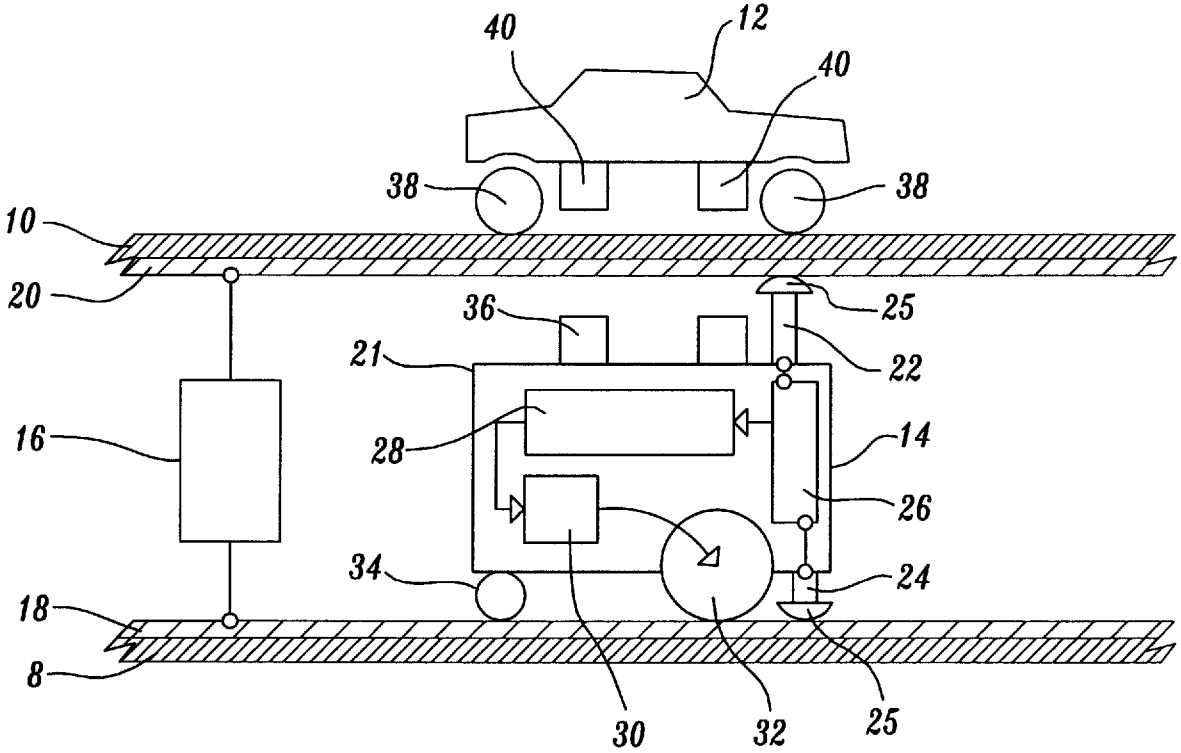
FIG. 2 is a diagrammatic section view of the upper roadway, lower roadway, surface vehicle and powered subsurface vehicle of the present invention.
Figure 3:
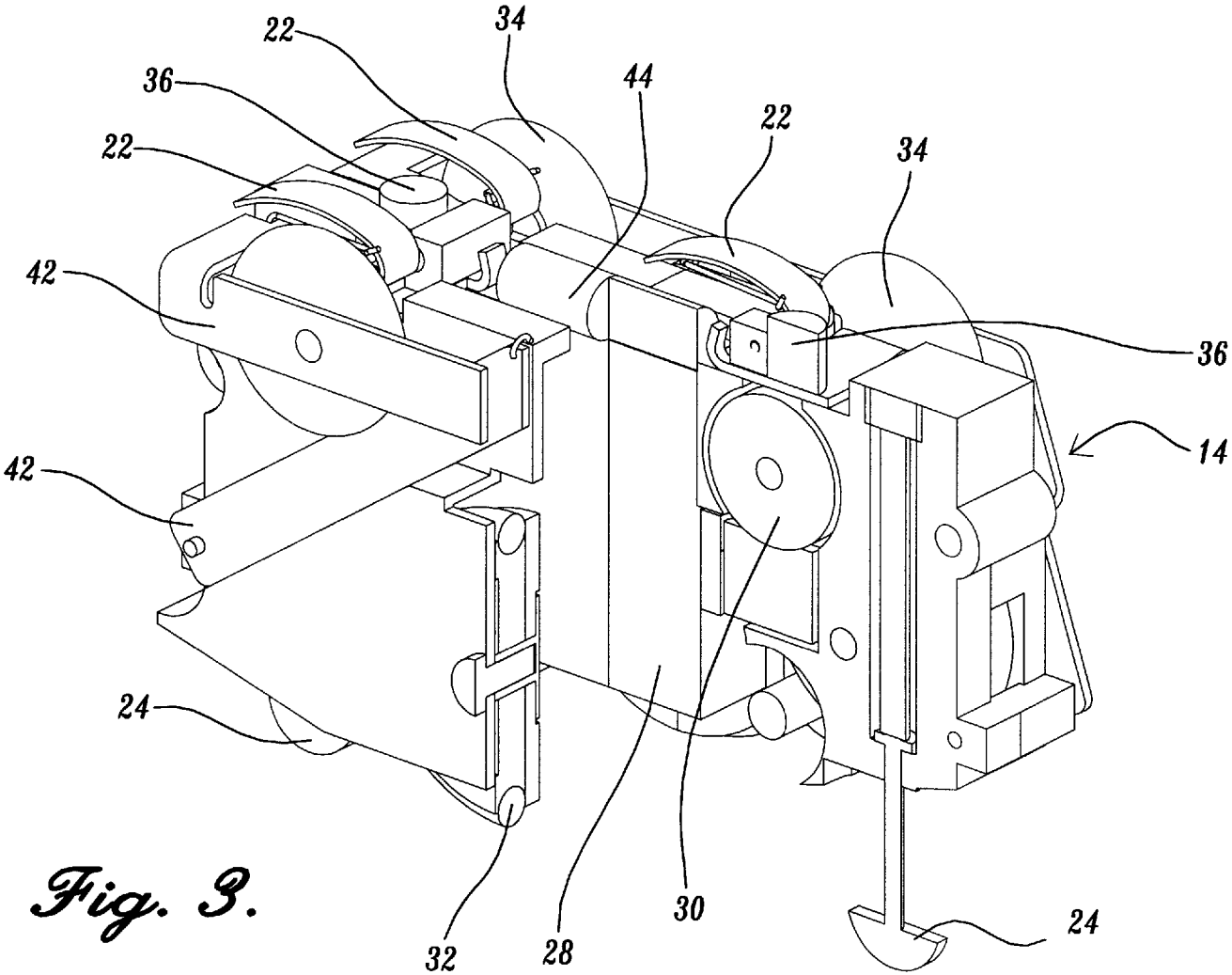
FIG. 3 is a partially exposed isometric view of the powered subsurface vehicle of the present invention.

The present invention is a toy vehicular drive apparatus as shown and described in FIGS. 1–8. As best shown in FIG. 1, the toy vehicular guidance apparatus of the present invention can be used in a toy building set 2 having a lattice 4 and modular bases 6. More specifically, lattice 4 provides the substructure of toy building set 2 and supports modular bases 6 which are spaced above lattice 4 by a predetermined distance. Lower roadway 8 is also supported by lattice 4, but on a lower portion of lattice 4 at a predetermined distance below modular bases 6. Upper roadway 10 is comprised of some of modular bases 6 that have been specialized in design to provide a smooth traffic bearing surface for movement of surface vehicles 12 thereon. Most preferably, the road pattern of upper roadway 10 and lower roadway 8 are identical so that subsurface vehicles 14, as shown in FIGS. 2 and 3, can travel on lower roadway 8 to guide surface vehicles 12 on upper roadway 10 in a manner further described below. Preferably, the distance between lower roadway 8 secured to lattice 4 and upper roadway 10, also secured to lattice 4, is large enough to allow ingress and travel of subsurface vehicle 14 between lower roadway 8 and upper roadway 10.

Next referring to FIG. 2, the magnetic interconnection between surface vehicle 12 and subsurface vehicle 14 is shown whereby subsurface vehicle 14 travels between lower roadway 8 and upper roadway 10 such that surface vehicle 12 can be transported on upper roadway 10 by subsurface vehicle 14. As shown in FIG. 2, power supply 16 interconnects a lower conductive layer 18 and upper conductive layer 20. Lower conductive layer 18 is located on the upper side of lower roadway 8. Upper conductive layer 20 is located on the under side of upper roadway 10. Power supply 16 thus energizes lower conductive layer 18 and upper conductive layer 20. Subsurface vehicle 14 accesses the electrical power in lower conductive layer 18 and upper conductive layer 20 in a manner described below to travel on lower roadway 8. Power supply 16 can be either direct current or alternating current, of preferably a shock safe voltage level, for example, about 12 volts. Lower conductive layer 18 and upper conductive layer 20 consist of thin metal sheets, foil layers or a conductive coating that may be, for example, polymeric. The conductive sheet, coating, or composite most preferably includes copper as the conductive metal.

Still referring to FIG. 2, subsurface vehicle 14 has a chassis 21 with an upper brush 22 located on the top of chassis 21 adjacent the under side of upper roadway 10 on which upper conductive layer 20 is located. Chassis 21 also has a lower brush 24 located on the under side thereof adjacent the upper surface of lower roadway 8 on which lower conductive layer 18 is located. Upper brush 22 and lower brush 24, which can be metal, graphite or conductive plastic, provide electrical interconnection between chassis 21 of subsurface vehicle 14 and upper conductive layer 20 and lower conductive layer 18, respectively for transfer of electrical power from power supply 16 to subsurface vehicle 14. Upper brush 22 and lower brush 24 are preferably elastic or spring loaded in order to accommodate changes in the distance between upper conductive layer 20 and lower conductive layer 18 to ensure a reliable electrical connection to subsurface vehicle 14. Upper brush 22 and lower brush 24 each have a head 25 that is contoured, or in another way shaped, for low friction sliding along upper conductive layer 20 and lower conductive layer 18, respectively, when subsurface vehicle 14 is in motion. Lower conductive layer 18 and upper conductive layer 20 can be located on substantially the entire upper surface of lower roadway 8 and under side of upper roadway 10, respectively, in order to ensure electrical interconnection of subsurface vehicle 14 to power supply 16 despite lateral movement across lower conductive layer 18 and upper conductive layer 20 by subsurface vehicle 14 due to, for example, turning of subsurface vehicle 14 or uncontrolled lateral movement thereof. Alternatively, lower conductive layer 18 and upper conductive layer 20 can be located in troughs or grooves in the upper surface of lower roadway 8 and the under side of upper roadway 10, respectively, into which head 25 of lower brush 24 and head 25 of upper brush 22, respectively, can reside in order to control the tracking of subsurface vehicle 14 in an electrically conductive environment by minimizing lateral movement of subsurface vehicle 14 relative to lower roadway 8 and upper roadway 10. Upper brush 22 and lower brush 24 are both electrically connected to control circuit 26 that is located on the front of chassis 21 of subsurface vehicle 14. Generally, control circuit 26 controls the electrical functioning of subsurface vehicle 14, and more specifically controls, and is electrically interconnected with, electromotor 28. Control circuit 26 thus controls the direction of movement, acceleration, deceleration, stopping, and turning of subsurface vehicle 14 based on external control signals, or control signals generated by subsurface vehicle 14 itself. Control circuit 26 is described in further detail below in conjunction with FIG. 8. Electromotor 28, electrically interconnected with control circuit 26, can be a direct current motor with brushes, a direct current brushless motor, or a stepper motor. Electromotor 28 is mechanically interconnected with transmission 30 that transfers rotation of electromotor 28 to drive wheel 32 employing the desired reduction ratio. More than one electromotor 28 can be employed for independent drive of a plurality of drive wheels 32. Additionally, transmission 30 can be a differential transmission to drive two or more drive wheels 32 at different speeds. In this manner, more sophisticated control of the acceleration, deceleration, and turning, for example, of subsurface vehicle 14 can be employed. Chassis support 34 is located on the under side of chassis 21 of subsurface vehicle 14. Chassis support 34 is spaced from drive wheel 32, also located on the under side of subsurface vehicle 14, and can be, for example, rollers or low friction drag plates that are preferably flexible to allow compensation for distance variation between lower roadway 8 and upper roadway 10. Magnets 36 are preferably disposed on the top of subsurface vehicle 14 adjacent the under side of upper roadway 10. Magnets 36 are preferably permanent magnets, but can also be electromagnets supplied with power from power supply 16 via control circuit 26.

Still referring to FIG. 2, surface vehicle 12, while preferably being a car, truck, or other vehicle, can be any type of device for which mobility is desired in the environment of a toy building set. Surface vehicle 12 includes wheels 38 which are rotatable to allow movement of surface vehicle 12 on upper roadway 10. Instead of wheels 38, a low friction drag plate can be employed. Magnets 40 are located on the under side of vehicle 12 adjacent upper roadway 10. Magnets 40 are sized and spaced on vehicle 12 to be aligned with magnets 36 on the top of chassis 21 of subsurface vehicle 14 for magnetic interconnection of surface vehicle 12 and subsurface vehicle 14.

Next referring to FIG. 3, a preferred embodiment of subsurface vehicle 14 is shown. Subsurface vehicle 14 of FIG. 3 is designed to move between an ABS lower roadway 8 with a lower conductive layer 18 of copper laminate and an ABS upper roadway 10 with an upper conductive layer 20 of copper laminate. Subsurface vehicle 14 of FIG. 3 has two drive wheels 32 and four chassis supports 34 (rollers) for stability and balance. It is important to note that, unlike the embodiment of subsurface vehicle 14 of FIG. 2, the embodiment of subsurface vehicle 14 of FIG. 3 has chassis supports 34 located on the upper portion of chassis 21 of subsurface vehicle 14, instead of underneath chassis 21 of subsurface vehicle 14. The orientation of chassis supports 34, which are preferably rollers, on the upper portion of chassis 21 increases the force on drive wheels 32 to minimize slipping thereof. Chassis supports 34 are located on frames 42, and are loaded by spring 44. The above configuration assures a substantially uniform force on drive wheels 32 regardless of the clearance between lower roadway 8 and upper roadway 10, and also facilitates passage of subsurface vehicle 14 along inclines or declines of lower roadway 8 and upper roadway 10. Magnets 36 are 0.1×0.125 inch round permanent rare earth magnets with residual flux around 9,000 Gauss. Preferably, the same type of magnets are employed for magnets 40 of surface vehicle 12. Reliable magnetic coupling has been observed at a distance of up to 0.2 inches between magnets 40 of surface vehicle 12 and magnets 36 of subsurface vehicle 14. Four upper brushes 22 are preferably present and are made from copper. Upper brushes 22 are loaded by torsion springs. Two lower brushes 24 are preferably present and are also made from copper. The lower brushes 24 are loaded by spiral springs. A rear magnet 62 and a side magnet 64 on each side of subsurface vehicle 14, preferably either permanent or electromagnets, are located on chassis 21 for collision avoidance with another subsurface vehicle 14 and for directional control of subsurface vehicle 14 as described further below. Electromotor 28 is preferably a direct current brush motor, for example, Mabuchi model No. SH-030SA, rated for 1.7 W maximum output at approximately 15,000 RPM at 12 volts of direct current power supply. Transmission 30 consists of one common worm stage and two separate, but identical two-stage gear trains for each of the two drive wheels 32. The total reduction ratio of transmission 30 is 1:133, and the efficiency is about 25 percent. Subsurface vehicle 14 operates at speeds of up to 4 inches per second at an incline of up to 15°.

Figure 4:
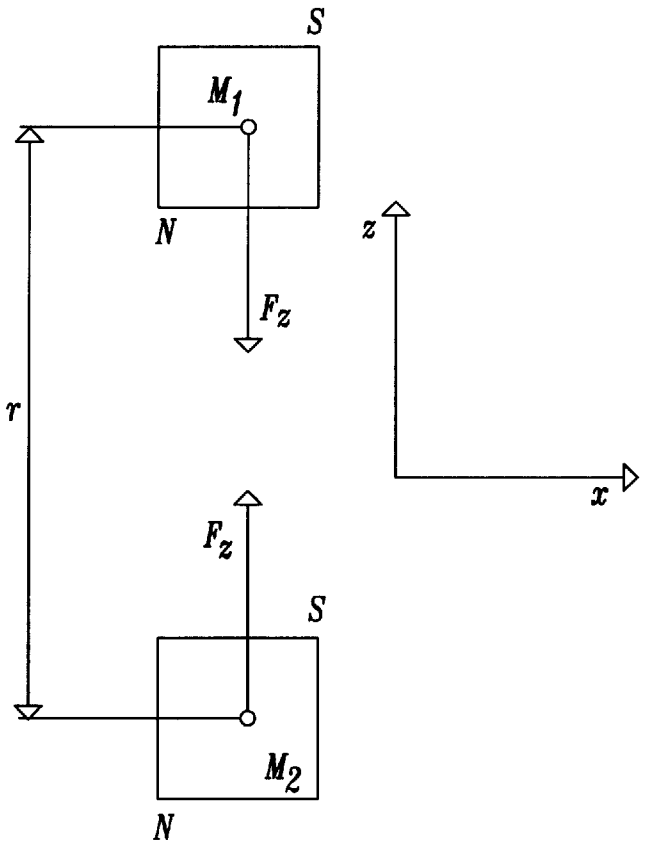
FIG. 4 is a diagrammatic section view of attractive forces between two magnets showing no offset.

Next referring to FIGS. 4–7, the principles of the magnetic forces interconnecting surface vehicle 12 and subsurface vehicle 14 by magnets 36 and magnets 40 are described. As shown in FIG. 4, when two magnets are placed one above the other, with opposite poles toward each other, a magnetic force $F_z$ between them exhibits based on the following equation:

$$F_z \approx 6\frac{M_1 \cdot M_2}{r^4}$$

where r is the distance between parallel planes in which magnets are situated and $M_1$, $M_2$ are magnetic moments of both magnets. For permanent magnets, M is proportional to the volume of magnetic substance cross its residual flux density. For electromagnets, M is proportional to the number of turns cross the current.

Figure 5:
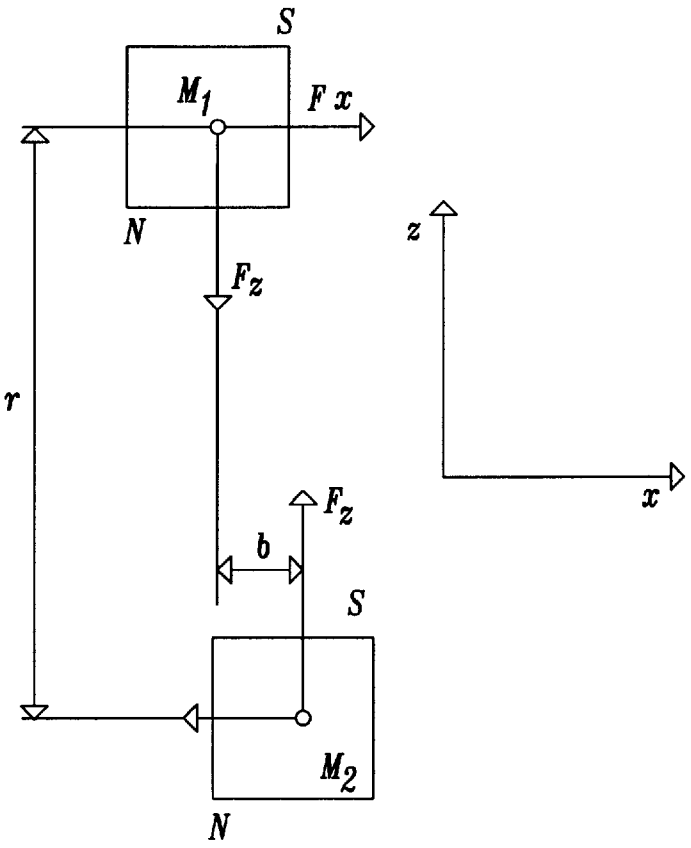
FIG. 5 is a diagrammatic section view of attractive forces between two magnets showing horizontal offset.

As shown in FIG. 5, when two magnets, one above the other, are shifted slightly to be horizontally offset by a distance b, the horizontal force $F_x$ occurs:

$$F_x \approx 6b\frac{M_1 \cdot M_2}{r^5}$$

Figure 6:
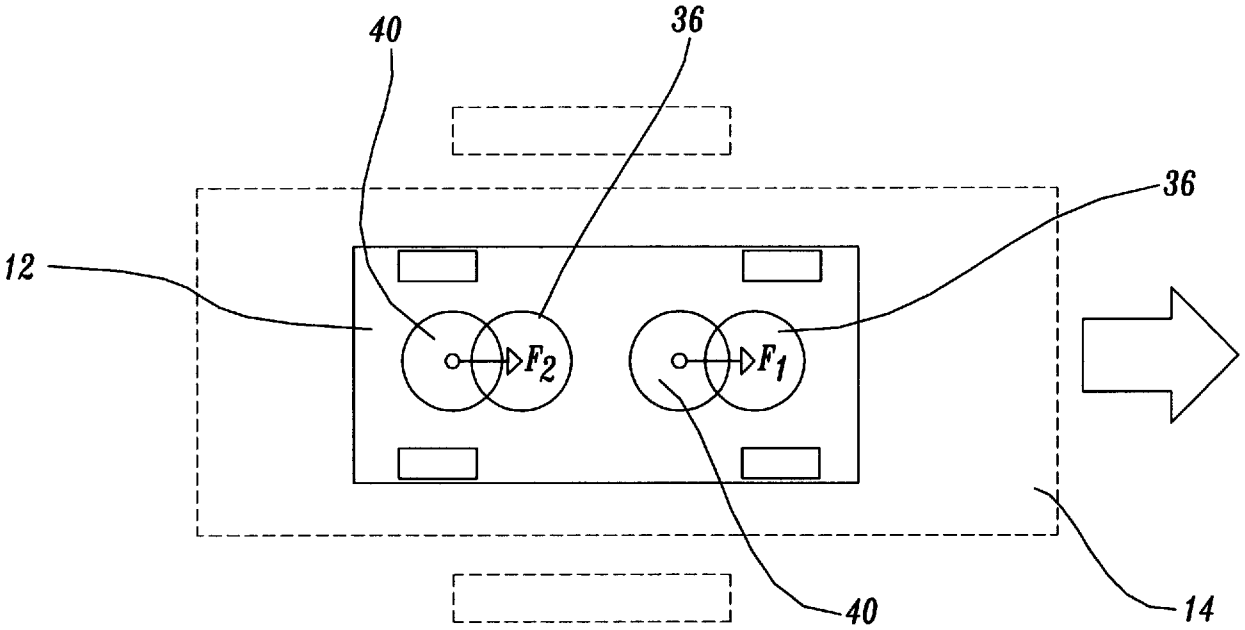
FIG. 6 is a diagrammatic plan view of the magnetic interaction between the surface vehicle and the subsurface vehicle of the present invention during straight movement.
Figure 7:
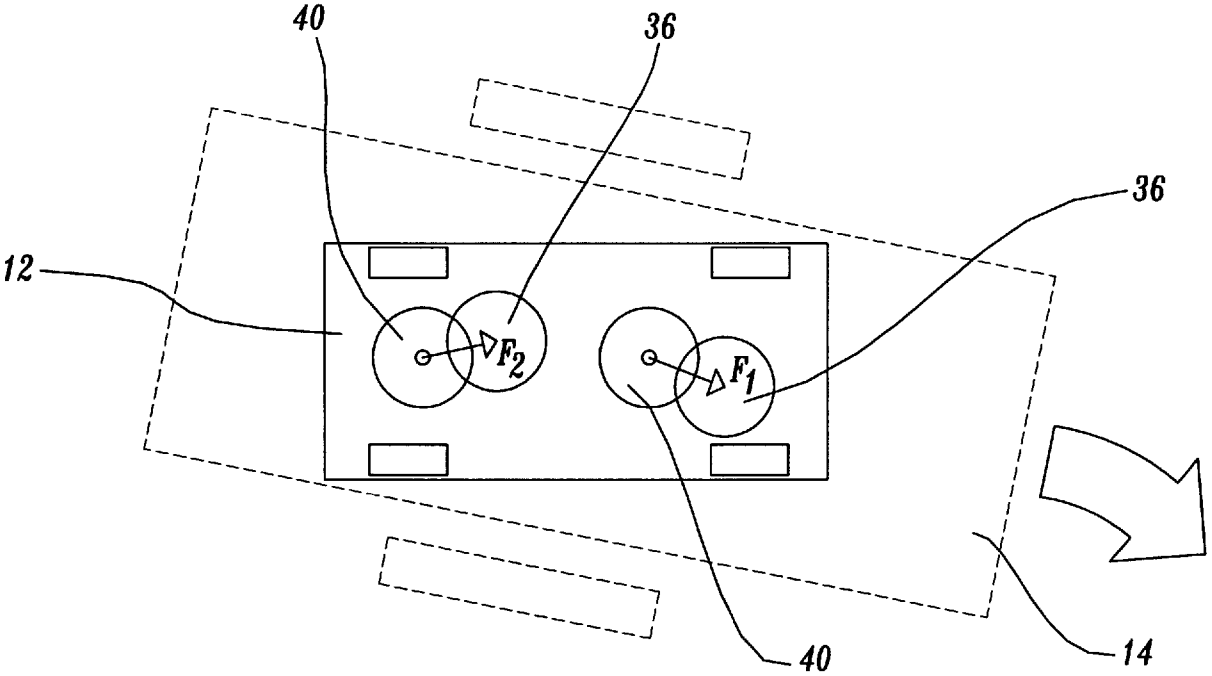
FIG. 7 is a diagrammatic plan view of the magnetic interaction between the surface vehicle and the subsurface vehicle of the present invention during a turn.

Next referring to FIGS. 6 and 7, the principles described above and shown in FIGS. 4 and 5 are discussed in relation to movement of nonpowered surface vehicle 12 by powered subsurface vehicle 14 due to the magnetic interconnection between magnets 40 of surface vehicle 12 and magnets 36 of subsurface vehicle 14. First referring to FIG. 6, during straight line movement, the horizontal offset b between surface vehicle 12 and subsurface vehicle 14 increases as subsurface vehicle 14 moves until forces $F_1$ and $F_2$ become large enough to overcome friction, inertia and, possibly, gravitational incline. At this point, surface vehicle 12 moves to follow subsurface vehicle 14. During a turn, as shown in FIG. 7, forces $F_1$ and $F_2$ have different directional vectors. Thus, forces $F_1$ and $F_2$ not only create thrust, but torque as well, that causes surface vehicle 12 to follow subsurface vehicle 14.

Figure 8:
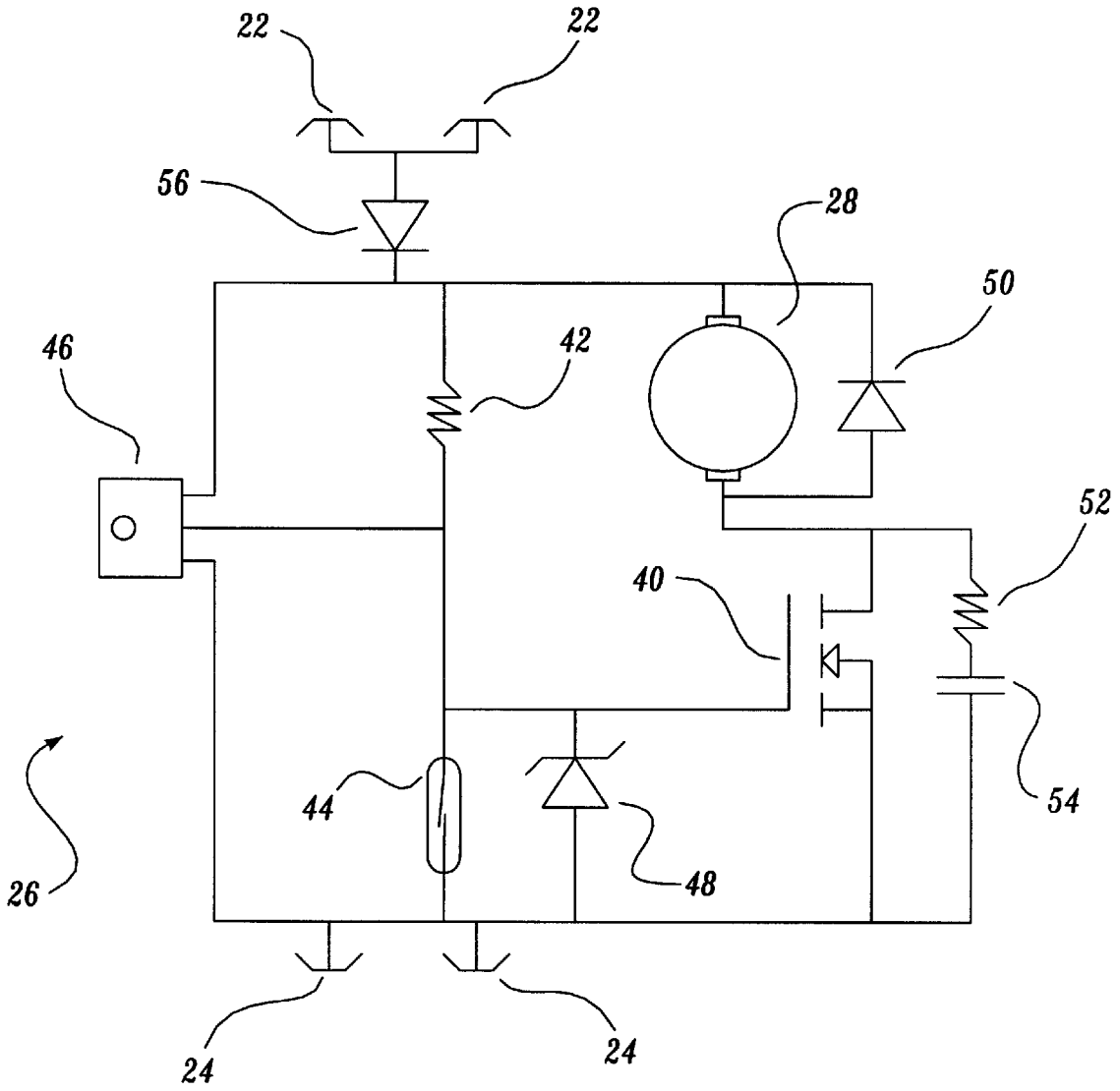
FIG. 8 is an electrical schematic of the control circuit of the subsurface vehicle of the present invention.

Now referring to FIG. 8, control circuit 26 is described in further detail. Control circuit 26 is electrically connected to both upper brushes 22 and lower brushes 24. Control circuit 26 includes an FET 40 (for example, model No. ZVN4206A manufactured by Zetex) that is normally open because of 10 k Ohm pull-up resistor 42. However, FET 40 deactivates electromotor 28 if a control or collision signal, for example either magnetic or optical, is detected by either reed switch 44 (for example, model No. MDSR-7 manufactured by Hamlin) or phototransistor 46 (for example, model no. QSE159 manufactured by QT Optoelectrics). Zener diode 48 (for example, model no. 1N5242 manufactured by Liteon Power Semiconductor) prevents overvoltage of the gate of FET 40. Diode 50 (for example, model no. 1N4448 manufactured by National Semiconductor), as well as an RC-chain consisting of 100 Ohm resistor 52 and 0.1 mcF capacitor 54, protect control circuit 26 from inductive spikes from electromotor 28. Diode 56 (for example, model no. 1N4004 manufactured by Motorola) protects control circuit 26 from reverse polarity of power supply 16. More specifically phototransistor 46 detects infrared light from IR emitters located at intersections of toy building set 2 to stop subsurface vehicle 14 in a manner further described below. Reed switch 44 is employed in collision avoidance of two subsurface vehicles 14 based upon detection of a magnetic signal to cause FET 40 to deactivate electromotor 28. As shown in FIG. 9, reed switch 44 of control circuit 26 is employed to prevent a rear end collision between a leading and a following subsurface vehicle 14. Control circuit 26 is preferably located on the front of following subsurface vehicle 14 so that reed switch 44 will be in close proximity to the magnetic field of rear magnet 62 of leading subsurface vehicle 14. When the following subsurface vehicle 14 closes to a predetermined distance, the magnetic field of rear magnet 62 of leading subsurface vehicle 14 is sensed by reed switch 44. Reed switch 44 causes FET 40 to deactivate electromotor 28, thus stopping the following subsurface vehicle 14. When the leading subsurface vehicle 14 moves away from the following subsurface vehicle 14, the increased distance therebetween removes the magnetic field of rear magnet 62 of leading subsurface vehicle 14 from proximity to reed switch 44 of following subsurface vehicle 14. FET 40 thus activates electromotor 28 for movement of following subsurface vehicle 14.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A toy vehicular drive apparatus comprising:

an electrically conductive first roadway;

an electrically conductive second roadway under said first roadway;

a powered subsurface vehicle movable on said second roadway;

means for powering said powered subsurface vehicle by electrically energizing said first roadway and said second roadway, said powered subsurface vehicle being in electrical communication with said first roadway and said second roadway for receipt of electrical energy to move said powered subsurface vehicle;

a surface vehicle movable on said first roadway; and means for interconnecting said powered subsurface vehicle and said surface vehicle to cause movement of said surface vehicle in response to movement of said powered subsurface vehicle.

2. The apparatus of claim 1, wherein said first roadway has an underside with electrically conductive material thereon, said second roadway has a top with electrically conductive material thereon, and said powered subsurface vehicle has electrically conductive elements in contact with said conductive material of said first roadway and of said second roadway.

3. The apparatus of claim 2, wherein said electrically conductive material is located on most of said underside of said first roadway and said top of said second roadway, and said conductive elements are low friction to allow lateral movement of said powered subsurface vehicle with respect to said first roadway and said second roadway while maintaining electrical interconnection of said powered subsurface vehicle with said first roadway and said second roadway.

4. The apparatus of claim 2, wherein said powered subsurface vehicle has a top and a bottom, said electrically conductive elements are located on said top and said bottom of said powered subsurface vehicle, and said electrically conductive elements are variable in height to maintain electrical interconnection of said powered subsurface vehicle with said first roadway and said second roadway as the distance between said first roadway and said second roadway changes.

5. The apparatus of claim 1, wherein said means for interconnecting said powered subsurface vehicle and said surface vehicle is a magnet on said powered subsurface vehicle and a magnet on said surface vehicle.

6. The apparatus of claim 5, wherein said magnet on said powered subsurface vehicle and said magnet on said surface vehicle are permanent magnets or electromagnets.

7. A toy vehicular drive apparatus comprising:

a first electrically conductive roadway;

a second electrically conductive roadway under said first roadway;

a powered subsurface vehicle movable on said second roadway, said subsurface powered vehicle being in electrical communication with said first roadway and with said second roadway;

means for powering said powered subsurface vehicle by electrically energizing said first roadway and said second roadway;

a surface vehicle movable on said first roadway; and means for interconnecting said powered subsurface vehicle and said surface vehicle to cause movement of said surface vehicle in response to movement of said powered subsurface vehicle.

8. The apparatus of claim 7, wherein said first roadway has an underside with electrically conductive material thereon, said second roadway has a top with electrically conductive material thereon, and said powered subsurface vehicle has electrically conductive elements in contact with said conductive material of said first roadway and of said second roadway.

9. The apparatus of claim 8, wherein said electrically conductive material is located on most of said underside of said first roadway and said top of said second roadway, and said conductive elements are low friction to allow lateral movement of said powered subsurface vehicle with respect to said first roadway and said second roadway while maintaining electrical interconnection of said powered subsurface vehicle with said first roadway and said second roadway.

10. The apparatus of claim 8, wherein said powered subsurface vehicle has a top and a bottom, said electrically conductive elements are located on said top and said bottom of said powered subsurface vehicle, and said electrically conductive elements are variable in height to maintain electrical interconnection of said powered subsurface vehicle with said first roadway and said second roadway as the distance between said first roadway and said second roadway changes.

11. The apparatus of claim 7, wherein said means for interconnecting said powered subsurface vehicle and said surface vehicle is a magnet on said powered subsurface vehicle and a magnet on said surface vehicle.

12. The apparatus of claim 11, wherein said magnet on said powered subsurface vehicle and said magnet on said surface vehicle are permanent magnets or electromagnets.

13. A toy vehicular drive apparatus comprising:

a first roadway having an electrically conductive underside;

a second roadway having an electrically conductive top and being under said first roadway;

a powered subsurface vehicle movable on said second roadway, said subsurface powered vehicle having electrically conductive elements in contact with said electrically conductive underside of said first roadway and in contact with said electrically conductive top of said second roadway;

means for powering said powered subsurface vehicle by electrically energizing said first roadway and said second roadway;

a surface vehicle movable on said first roadway; and means for interconnecting said powered subsurface vehicle to cause movement of said surface vehicle in response to movement of said powered subsurface vehicle.

14. The apparatus of claim 13, wherein said first roadway and said second roadway have electrically conductive material located on most of said underside of said first roadway and said top of said second roadway, and said conductive elements are low friction to allow lateral movement of said powered subsurface vehicle with respect to said first roadway and said second roadway while maintaining electrical interconnection of said powered subsurface vehicle with said first roadway and said second roadway.

15. The apparatus of claim 13, wherein said powered subsurface vehicle has a top and a bottom, said electrically conductive elements are located on said top and said bottom of said powered subsurface vehicle, and said electrically conductive elements are variable in height to maintain electrical interconnection of said powered subsurface vehicle with said first roadway and said second roadway as the distance between said first roadway and said second roadway changes.

16. The apparatus of claim 13, wherein said means for interconnecting said powered subsurface vehicle and said surface vehicle is a magnet on said powered subsurface vehicle and a magnet on said surface vehicle.

17. The apparatus of claim 16, wherein said magnet on said powered subsurface vehicle and said magnet on said surface vehicle are permanent magnets or electromagnets.

18. In a toy vehicular drive apparatus having a first electrically conductive roadway, a second electrically conductive roadway under the first electrically conductive roadway, a power source for electrically energizing the first roadway and the second roadway, and a surface vehicle movable on the first roadway, a powered subsurface vehicle comprising:

a chassis having a power source and being movable on the second electrically conductive roadway;

means for electrically interconnecting said power source to the first electrically conductive roadway and the second electrically conductive roadway to move said powered subsurface vehicle; and means for interconnecting said powered subsurface vehicle and the surface vehicle to cause movement of the surface vehicle in response to movement of said powered subsurface vehicle.

19. The vehicle of claim 18, wherein the first roadway has an underside with electrically conductive material thereon, the second roadway has a top with electrically conductive material thereon, and said powered subsurface vehicle has electrically conductive elements in contact with said conductive material of the first roadway and of the second roadway.

20. The vehicle of claim 19, wherein the electrically conductive material is located on most of the underside of the first roadway and the top of the second roadway, and said conductive elements of said powered subsurface vehicle are low friction to allow lateral movement of said powered subsurface vehicle with respect to the first roadway and the second roadway while maintaining electrical interconnection of said powered subsurface vehicle with the first roadway and the second roadway.

21. The vehicle of claim 20, wherein said powered subsurface vehicle has a top and a bottom, said electrically conductive elements are located on said top and said bottom of said powered subsurface vehicle, and said electrically conductive elements are variable in height to maintain electrical interconnection of said powered subsurface vehicle with the first roadway and the second roadway as the distance between the first roadway and the second roadway changes.

22. The vehicle of claim 18, wherein said means for interconnecting said powered subsurface vehicle and the surface vehicle is a magnet on said powered subsurface vehicle and a magnet on the surface vehicle.

23. The vehicle of claim 22, wherein said magnet on said powered subsurface vehicle and the magnet on the surface vehicle are permanent magnets or electromagnets.

* * * * *